US010252127B2

(12) United States Patent
Van Nguyen et al.

(10) Patent No.: US 10,252,127 B2
(45) Date of Patent: Apr. 9, 2019

(54) BASEBALL/SOFTBALL BAT WITH OUTER LOCKING SYSTEM HAVING SHOCK DISSIPATION CHARACTERISTICS

(71) Applicant: Xiamen Pheasant Hi-Tech Aluminum Co., Ltd., Xiamen, Fujian (CN)

(72) Inventors: Thu Van Nguyen, West Hills, CA (US); Renqin Zhang, Houxi (CN); Chi-Hung Lee, Houxi (CN)

(73) Assignee: Xiamen Pheasant Hi-Tech Aluminum Co., Ltd., Fujian (CN)

( * ) Notice: Subject to any disclaimer, the term of this patent is extended or adjusted under 35 U.S.C. 154(b) by 0 days.

(21) Appl. No.: 16/133,217

(22) Filed: Sep. 17, 2018

(65) Prior Publication Data

US 2019/0015720 A1 Jan. 17, 2019

Related U.S. Application Data

(63) Continuation-in-part of application No. PCT/US2018/039960, filed on Jun. 28, 2018, which is a continuation-in-part of application No. 15/714,670, filed on Sep. 25, 2017, now Pat. No. 10,016,667, which is a continuation-in-part of application No. 14/584,078, filed on Dec. 29, 2014, now abandoned.

(51) Int. Cl.

| | |
|---|---|
| ***A63B 59/51*** | (2015.01) |
| ***A63B 60/08*** | (2015.01) |
| ***A63B 60/14*** | (2015.01) |
| ***A63B 60/54*** | (2015.01) |
| ***A63B 102/18*** | (2015.01) |

(52) U.S. Cl.

CPC ..... *A63B 60/54* (2015.10); *A63B 60/08* (2015.10); *A63B 60/14* (2015.10); *A63B 59/51* (2015.10); *A63B 2102/18* (2015.10); *A63B 2102/182* (2015.10); *A63B 2209/00* (2013.01)

(58) Field of Classification Search

CPC ..... A63B 60/54; A63B 60/08; A63B 60/14; A63B 2102/18

See application file for complete search history.

(56) References Cited

U.S. PATENT DOCUMENTS

| | | | |
|---|---|---|---|
| 4,951,948 | A | 8/1990 | Peng |
| D476,409 | S | 7/2003 | Van Nguyen |
| 6,808,464 | B1 | 10/2004 | Van Nguyen |
| 6,820,654 | B2 | 11/2004 | Lindsay |
| 6,896,006 | B2 | 5/2005 | Lindsay |
| 7,014,580 | B2 | 3/2006 | Forsythe |
| 7,052,419 | B2 | 5/2006 | Chang |
| 7,166,046 | B1 | 1/2007 | Liu |
| 7,201,679 | B2 | 4/2007 | Van Nguyen |
| 7,207,354 | B2 | 4/2007 | Lindsay |
| 7,311,620 | B1 | 12/2007 | Heald |

(Continued)

*Primary Examiner* — Eugene L Kim
*Assistant Examiner* — Christopher A Glenn
(74) *Attorney, Agent, or Firm* — Kelly & Kelley, LLP

(57) ABSTRACT

A multi-component baseball or softball bat has a vibration absorber affixed to an end of the handle. The vibration absorber has a first section disposed within an end of the barrel of the bat and a second section disposed outside of the barrel. An outer locking sleeve has a first portion disposed over an end of the barrel and a second portion disposed over the second section of the vibration absorber. A vibration sleeve may be disposed between the outer surface of the barrel and an inner surface of the first portion of the outer locking sleeve.

24 Claims, 11 Drawing Sheets

(56) References Cited

U.S. PATENT DOCUMENTS

| | | | |
|---|---|---|---|
| 7,314,067 | B2 | 1/2008 | Lindsay |
| 7,328,599 | B2 | 2/2008 | Van Nguyen |
| 7,344,461 | B2 | 3/2008 | Van Nguyen |
| 7,377,866 | B2 | 5/2008 | Van Nguyen |
| 7,381,141 | B2 | 6/2008 | Van Nguyen |
| 7,475,705 | B2 | 1/2009 | Lindsay |
| 2005/0196570 | A1 | 9/2005 | Lindsay |
| 2008/0058132 | A1 | 3/2008 | Van Nguyen |
| 2011/0098141 | A1 | 4/2011 | Burger |

BASEBALL/SOFTBALL BAT WITH OUTER LOCKING SYSTEM HAVING SHOCK DISSIPATION CHARACTERISTICS

RELATED APPLICATIONS

This application claims priority to PCT Patent Application Ser. No. PCT/US2018/39960, filed on Jun. 28, 2018, which claims priority to U.S. application Ser. No. 15/714,670, filed Sep. 25, 2017, now U.S. Pat. No. 10,016,667 B2, which is a continuation-in-part of application Ser. No. 14/584,078, filed on Dec. 29, 2014.

BACKGROUND OF THE INVENTION

The present invention generally relates to baseball and softball bats. More particularly, the present invention relates to a multi-component bat having shock dissipation characteristics and an outer locking sleeve to create a rigid connection between the barrel and handle of the bat.

Baseball and softball are very popular sports in many countries, including the United States, Mexico, Japan and elsewhere. Due to the competitive nature of these sports, players are constantly seeking ways of improving their performance. An important aspect of baseball and softball is the ability to effectively hit the ball.

Typically, wooden bats are used at the professional levels, while metal, such as aluminum alloy, and composite material bats are used extensively in other leagues and levels, and particularly in baseball amateur play from Little League to college levels and also in slow- and fast-pitch softball. Metal and composite bats are advantageous over wood bats in that they do not break and splinter like wood bats and thus can be used repeatedly with consequent cost savings. Metal and composite bats also have a larger optimal hitting area or power zone than wood bats.

However, these bats have certain disadvantages. Bats comprised of metal or composite materials or combinations thereof vibrate upon impact. The shock caused by the bat hitting the ball may send painful vibrations into the hands and arms of the batter if the ball is not hit at the sweet spot of the bat.

Attempts to create multi-component bats, particularly those having vibration dissipating or absorbing characteristics, have often been complicated in nature and assembly and formation. The interconnection point between the various components of the bat, such as the handle and the barrel, are prone to failure as the bat is used repeatedly, causing connection points and internal devices to break over time. The joint or connection between the handle and the bat barrel is especially prone to failure. It is preferable that there be dampening of vibrations between the barrel and the handle while still maintaining a substantially rigid connection between the barrel and handle.

Accordingly, there is a continuing need for a bat which is not complex in design and is not expensive to manufacture or assemble and which is not prone to structural failure. Moreover, a bat is needed which effectively dissipates vibrations and shock caused when hitting an object, such as a baseball or softball, while still maintaining a rigid and durable connection between the handle and barrel. The present invention fulfills these needs and provides other related advantages.

SUMMARY OF THE INVENTION

The present invention generally resides in a baseball or softball bat which is multi-component in nature, has shock dissipating properties and characteristics, as well as a rigid connection between the handle and the barrel of the bat. The multi-component bat is relative simple in design and not expensive to manufacture or assemble.

The baseball or softball bat generally comprises a barrel having a distal end and a proximal end. A handle comprising a first end segment defines a grip. A second end segment of the handle is at least partially disposed within the proximal end of the barrel.

A vibration absorber is affixed to the second end segment of the handle and comprised of a shock absorbing material. The vibration absorber may comprise an elastomeric material. The vibration absorber may be molded onto the second end of the handle.

The vibration absorber has a first section disposed within the proximal end of the barrel so as to contact an inner surface thereof. A second section of the vibration absorber is disposed outside of the barrel and has projections or depressions on an external surface thereof. An outer surface of the first section of the vibration absorber may be configured so as to substantially mate with an inner surface of the proximal end of the barrel. Typically, an inner surface of the proximal end of the barrel is generally frustoconical and the outer surface of the first section of the vibration absorber is frustoconical so as to substantially contact the inner surface of the proximal end of the barrel.

The inner surface of the proximal end of the barrel and the first section of the vibration absorber may include one or more corresponding projections and depressions so as to lockingly engage one another. The projection and depression may be annular, such as an annular ring extending from the vibration absorber and insertable into an annular depression of the barrel.

An outer locking sleeve has a first portion disposed over the proximal end of the barrel and a second portion disposed over the second section of the vibration absorber. The outer locking sleeve typically comprises a rigid material. A first portion of the outer locking sleeve has projections or depressions, such as threads, formed on an inner surface thereof that engage corresponding projections or depressions of an outer surface of the proximal end of the barrel. The second portion of the outer locking sleeve has projections or depressions, such as threads, formed on an inner surface thereof that engage the corresponding projections or depressions, which may be threads, of the vibration absorber. Engaging the threads or other projections or depressions of the outer locking sleeve to the proximal end of the barrel and the vibration absorber securely locks the barrel to the handle.

The outer locking sleeve may include a plurality of slots formed therethrough between the first and second ends of the outer locking sleeve. A sensor may be disposed within a slot of the outer locking sleeve.

A vibration dampening sleeve may be disposed between an outer surface of the proximal end of the barrel and an inner surface of the first portion of the locking sleeve. The vibration dampening sleeve may have external threads that engage internal threads of the first portion of the locking sleeve. A flexible adhesive may be disposed between inner surfaces of the outer locking sleeve and outer surfaces of the vibration absorber, vibration dampening sleeve, and proximal end of the barrel.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a multi-component baseball or softball bat, generally referred to by the reference number 10. The bat 10 has vibration absorbing and shock dissipating characteristics, such that shockwaves and other energy generated by a barrel of the bat hitting an object, such as a ball, are absorbed or muted so that they are not fully transferred to the handle of the bat and the user's hands. The bat also includes means for rigidly securing the barrel to the handle, as will be more fully described below.

Figure 1:
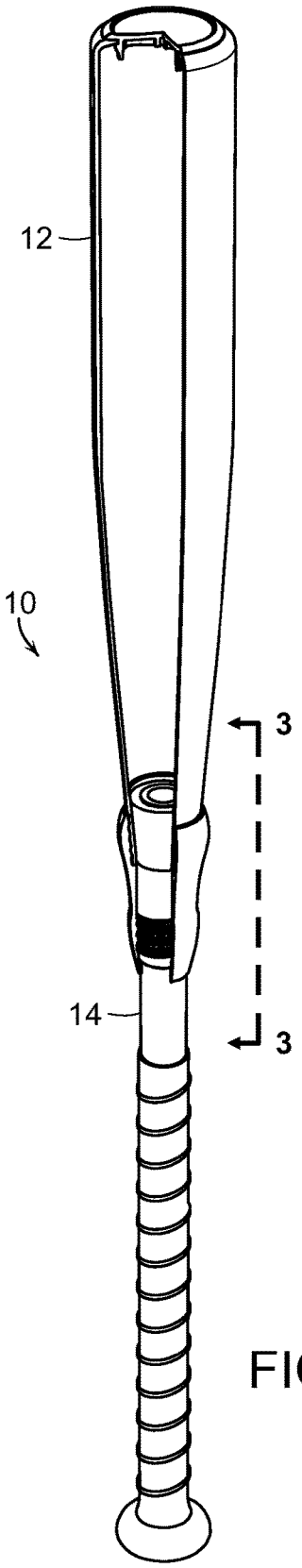
FIG. 1 is a front elevational view of a bat embodying the present invention.
Figure 2:
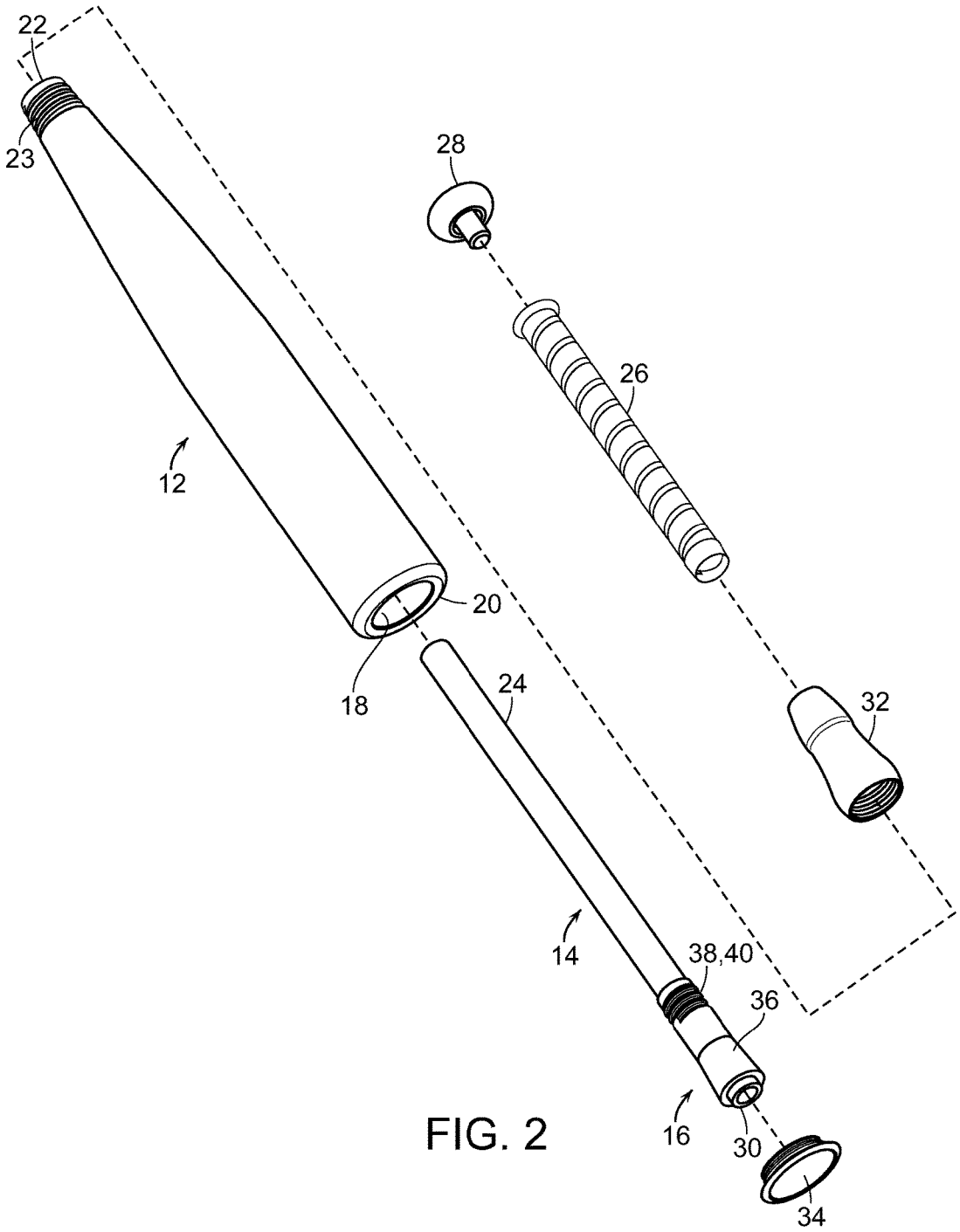
FIG. 2 is an exploded perspective view of components of the bat of FIG. 1.

With reference now to FIGS. 1 and 2, a bat 10 embodying the present invention is illustrated. The bat 10 is generally comprised of a barrel 12 and a handle 14 attachable to the barrel 12. The barrel 12 and handle 14 may be comprised of any suitable material, including metal such as aluminum or an aluminum alloy, a laminate composite material, such as composite fibers or sheets which may be pre-impregnated with resins and the like.

Typically, the barrel 12 is generally hollow. The handle 14 is inserted through an opening 18 of a distal end 20 of the barrel 12 and through an open proximal end 22 of the barrel 12. A first end segment 24 of the handle 14 defines a grip portion of the bat 10. A grip 26 may be placed over the first end segment or grip portion 24 of the handle 14. The grip 26 is typically comprised of a material which is comfortable to the user while providing a degree of friction or gripability so as to securely hold and swing the bat 10 in use. A knob 28 may be attached to the end of the handle 14, adjacent the grip 26, to prevent the user's hands from slipping off of the end of the bat 10 when swinging the bat 10.

A second end segment 30 of the handle 14, generally opposite the first end segment 24, is at least partially disposed within the proximal end 22 of the barrel 12. A vibration absorber 16 is affixed to the second end segment of the handle 30 and a portion thereof is configured so as to generally conform to and mate with the inner surface of the proximal end 22 of the barrel 12. As can be shown in the various figures, the proximal end 22 of the barrel 12 is generally frustoconical in configuration, so as to slope or taper inwardly, as shown. Typically, as illustrated, the outer surface of the proximal end 22 of the barrel 12 includes projections or depressions, such as threads 23. An outer locking sleeve 32 is configured so as to be disposed over the proximal end 22 of the barrel 12 and a portion of the vibration absorber 16 so as to securely connect and lock the handle 14 and the barrel 12 to one another. A cap 34 may be attached to the distal end 20 of the barrel 12 so as to cover opening 18 as part of the assembly of the bat 10.

Figure 3:
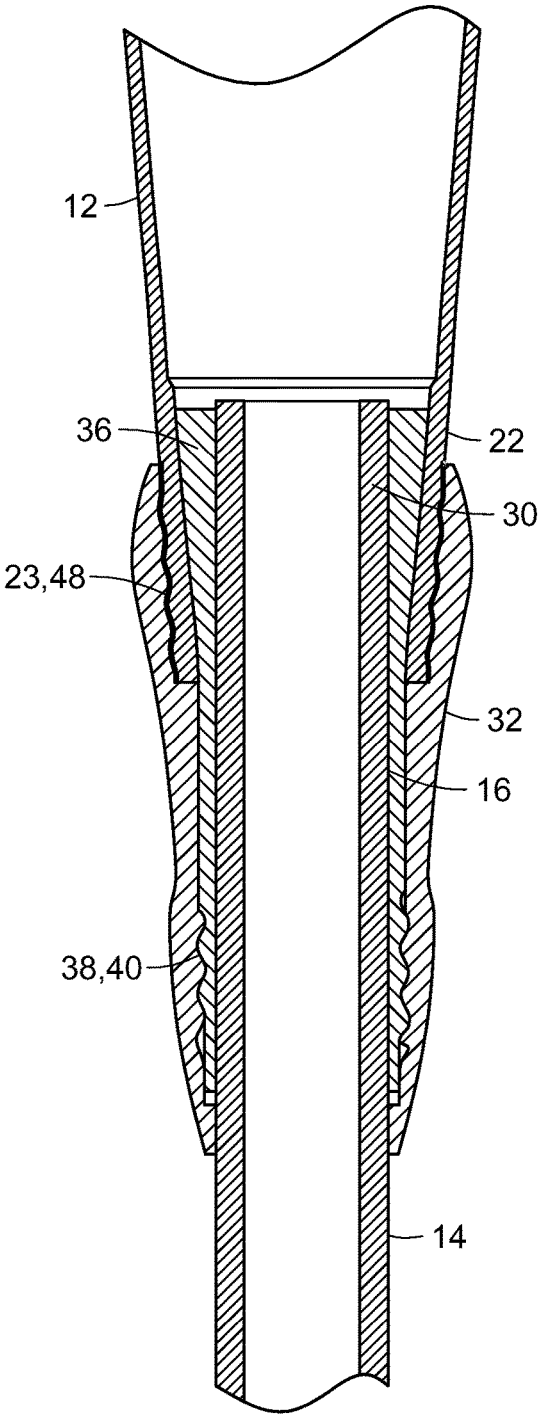
FIG. 3 is a cross-sectional view taken generally along lines 3-3 of FIG. 1, illustrating a barrel and handle of the bat securely connected to one another, in accordance with the present invention.

With reference now to FIGS. 2 and 3, the vibration absorber 16, which is comprised of a shock absorbing material, such as an elastomeric material, is attached to the second end 30 of the handle 14. The vibration absorber 16 includes a first section 36 which is disposed within the proximal end 22 of the barrel 12, so as to contact an inner surface thereof. A second section 38 of the vibration absorber 16 is disposed outside of the barrel 12. The second section 38 of the vibration absorber 16 includes projections or depressions 40, such as threads, formed on an external surface thereof.

Figure 4:
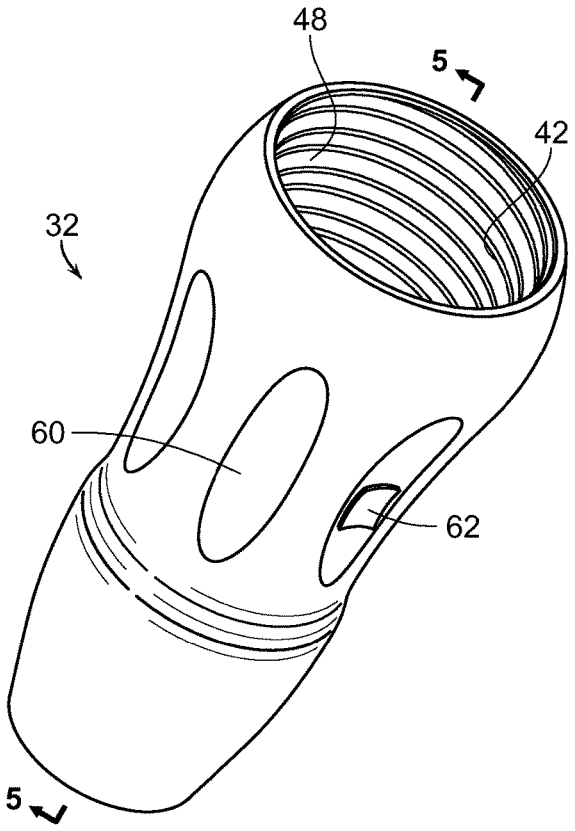
FIG. 4 is a perspective view of an outer locking sleeve embodying the present invention.
Figure 5:
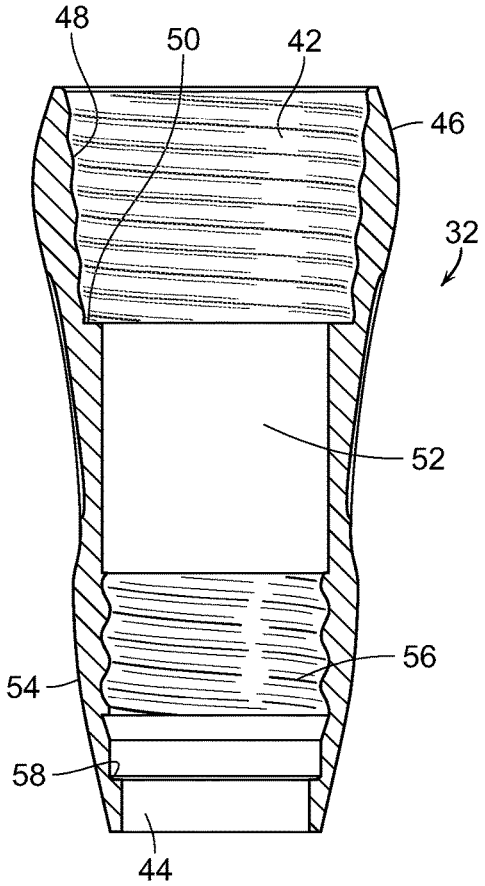
FIG. 5 is a cross-sectional view taken along lines 5-5 of FIG. 4.

With reference now to FIGS. 4 and 5, a perspective and cross-sectional view of an outer locking sleeve 32 are shown. The outer locking sleeve 32 is typically comprised of a rigid material, which may be comprised of a metal or non-metal material, such as a rigid plastic or the like. The outer locking sleeve 32 is generally hollow and includes an aperture or opening 42 at a first end thereof as well as an aperture or opening 44 at a second end thereof which are generally aligned with one another such that the outer locking sleeve 32 can be slid over the handle 14 during assembly. As mentioned above, the outer locking sleeve 32 is disposed over the proximal end 22 of the barrel 12 and the second section 38 of the vibration absorber 16, which is attached to the end 30 of the handle 14, so as to securely lock the barrel 12 to the handle 14 and eliminate weakness and flexion at the joint or junction of the handle 14 and barrel 12.

The outer locking sleeve 32 includes a first portion 46 which is disposed over the proximal end 22 of the barrel 12. The inner surface of the first portion 46 of the outer locking sleeve 32 may conform to the outer surface of the proximal end 22 of the barrel 12, such as being tapered and including projections or depressions, such as threads 48, which are configured to be attached to the outer threads 23 of the proximal end 22 of the barrel 12. The outer locking sleeve 32 may include an internal ledge 50 against which the end of the barrel 12 engages or rests so as to serve as a stop. A central section 52 of the outer locking sleeve 32 is hollow and may have a configuration substantially matching that of a central portion of the vibration absorber 16 and/or handle 14. Typically, the outer surface of a central portion of the vibration absorber 16 is in contact with the inner surfaces of the central section 52 of the outer locking sleeve 32.

A second portion 54 of the outer locking sleeve 32, generally opposite the first portion 46, is configured to be placed over the second section of the vibration absorber 16, which extends from the barrel 12 of the bat 10. Projections or depressions 56, such as threads, are formed on an inner surface of the second portion 54 which engage the corresponding threads or other projections or depressions of the exposed second section 54 of the vibration absorber so as to securely lock the barrel 12 to the handle 14. A ledge or stop 58 may be formed on an inner surface of the outer locking sleeve 32 to engage an end of the vibration absorber 16. Preferably, as the outer locking sleeve 32 is fully threadedly connected to the vibration absorber 16, the end of the barrel 12 will come into contact with ledge or stop 50 as the end of the vibration absorber comes into contact with ledge or stop 58.

As shown in FIG. 4, slots 60 may be formed in the outer locking sleeve 32, such as in a central portion thereof. This may be done in order to reduce the total weight of the outer locking sleeve 32 depending upon the weight-to-length ratio requirement for the bat 10. One or more sensors 62 may be placed within the one or more slots 60 which may be utilized to monitor aspects of the use of the bat, such as for bad swing, etc. which can be monitored through a wireless connection.

Figure 6:
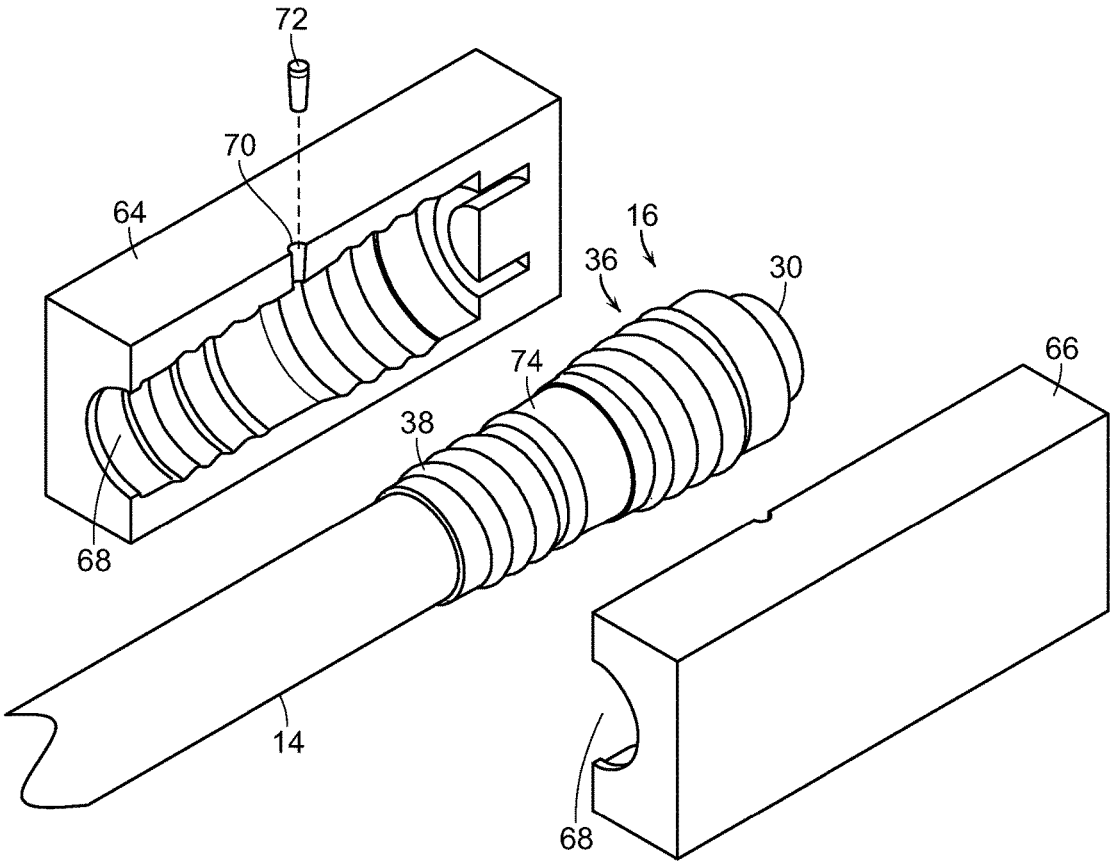
FIG. 6 is a diagrammatic view illustrating molding of a vibration absorber onto an end of the bat handle, in accordance with the present invention.

With reference now to FIG. 6, the vibration absorber 16 can be attached to the handle 14 by various means. Although a separate vibration absorber 16 could be created and attached, such as by adhesive connection, to the end of the handle 14, this would present several drawbacks. For example, this approach would entail additional manufacturing and assembly steps. Moreover, the connection points between the handle 14 and the vibration absorber 16 could be prone to failure as the adhesive or mechanical attachments break over time due to repeated hitting of a ball or other object by the bat 10. Accordingly, in a preferred embodiment, as illustrated in FIG. 6, in the invention the vibration absorber 16 is molded onto the handle 14. Mold members 64 and 66 cooperatively define an inner cavity 68 defining the configuration of the vibration absorber 16. An aperture 70 may receive an injection needle 72 for injecting the material forming the vibration absorber 16 into the joined mold members 64 and 66, which surround the end 30 of the handle 14 so as to mold the vibration absorber 16 onto the handle 14. The vibration absorber 16 is comprised of a shock absorbing material, such as an elastomeric material.

As mentioned above, the vibration absorber 16 includes a first section 36 which is disposed within the proximal end 22 of the barrel 12, so as to contact an inner surface thereof. Preferably, the first section 36 of the vibration absorber 16 is configured so as to substantially mate with or conform to an inner surface of the proximal end of the barrel. In this manner, the shockwaves and other energy are more effectively transmitted from the barrel 12, upon hitting an object, to the vibration absorber 16. In the case illustrated in FIG. 6, the first section 36 of the vibration absorber 16 includes projections and depressions, such as threads, which could be threadedly connected to corresponding threads formed on an internal surface of the proximal end 22 of the barrel 12. Such an arrangement would facilitate connection of the handle 14 to the barrel 12.

The shock absorber 16 also includes a central section 74 which typically has a smooth outer configuration. The second section 38 of the vibration absorber 16 includes projections or depressions, such as threads, formed on an outer surface thereof and which engage the corresponding projections or depressions, such as threads, on the inner surface 56 of the outer locking sleeve 32.

Figure 7:
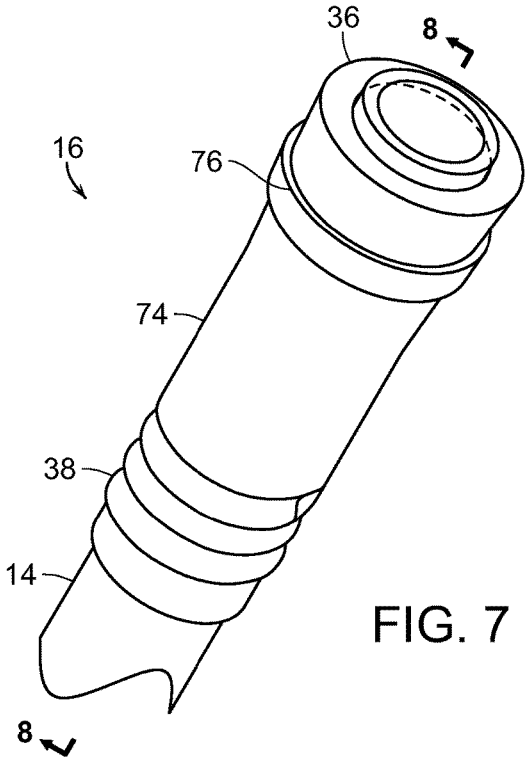
FIG. 7 is a perspective view of another vibration absorber affixed to the bat handle.
Figure 8:
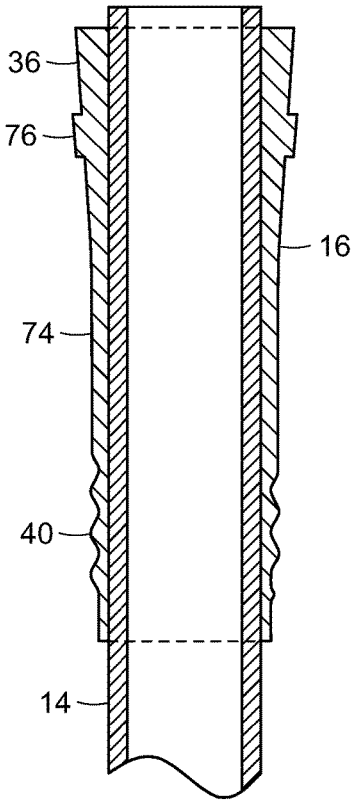
FIG. 8 is a cross-sectional view of FIG. 7.
Figure 9:
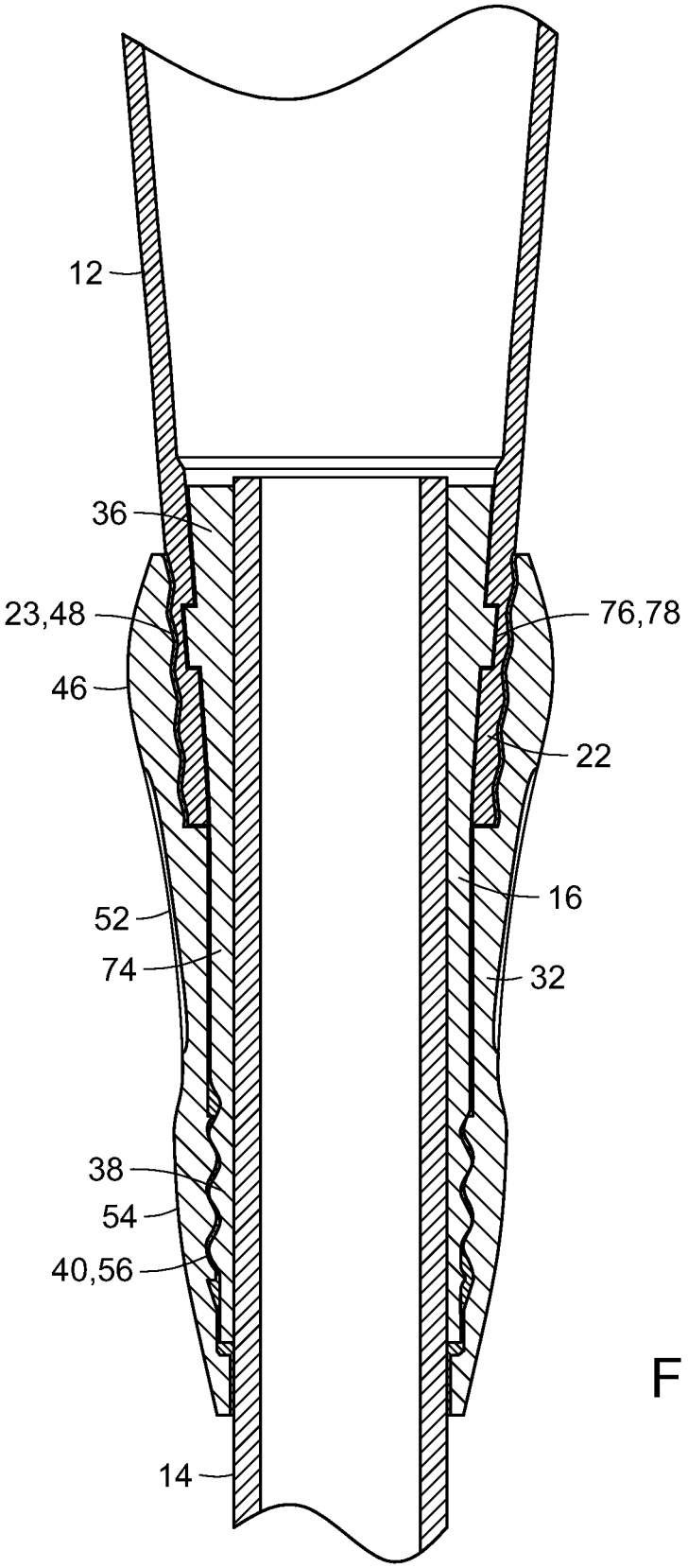
FIG. 9 is a cross-sectional view of a portion of a bat incorporating the vibration dampener of FIG. 7, in accordance with the present invention.

With reference now to FIGS. 7-9, the vibration absorber 16 may be configured such so as to have a projection or depression which corresponds with a projection or depression formed on an inner surface of the proximal end 22 of the barrel 12. For example, as illustrated, a single annular ring 76 is formed in the first section 36 of the vibration absorber 16 which is insertable into a corresponding single annular depression 78 of the barrel 12, as illustrated in FIG. 9. The ring 76 may be snap-fit into place and locking engagement with the annular depression or groove 78. This serves to secure the handle 14 to the barrel 12 and provide positive engaging surfaces therebetween so that vibrations and other energy is imparted from the barrel 12 to the vibration absorber 16.

As can be seen in FIG. 9, and other figures, the vibration absorber 16 is disposed between the barrel 12 and the handle 14, such that the handle 14 does not come into contact with the barrel 12 and instead all vibrations and other energy from the barrel 12 is diverted into the vibration absorber 16 such that the vibrations and energy are dissipated so as to prevent the painful vibrations from being transmitted in full force to the hands of the user who is holding the grip portion of the handle 14 during use of the bat 10. It can also be seen in these figures that the outer locking sleeve 32 extends over the exterior of the proximal end 22 of the barrel 12 as well as the first end 30 of the handle 14 and provides a rigid connection between the barrel 12 and the handle 14 to reduce or eliminate weakness at the joint between the barrel 12 and handle 14 and reduce or eliminate flexion at the junction between the barrel 12 and handle 14. Disposing the outer locking sleeve 32 on the outside of the barrel 12 and handle 14 also creates vibration dampening outside of these structures.

Figure 10:
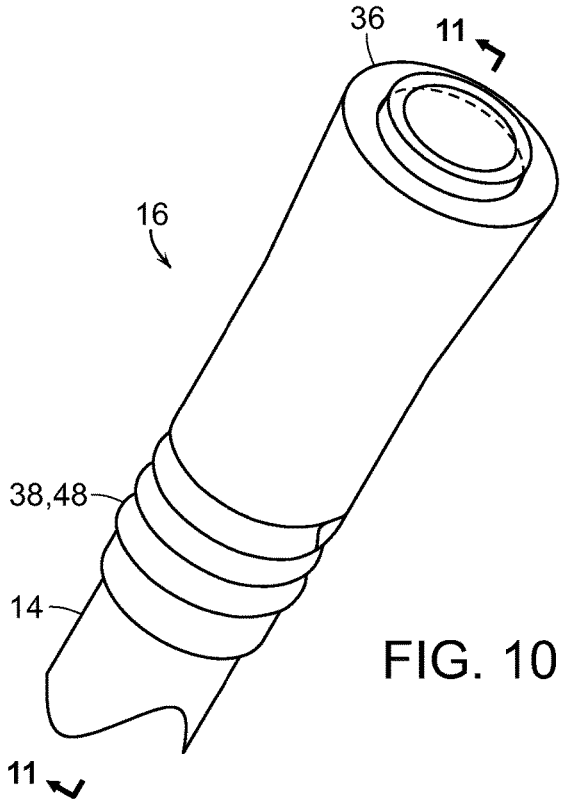
FIG. 10 is a perspective view of another vibration absorber affixed to the end of the handle, in accordance with the present invention.
Figure 11:
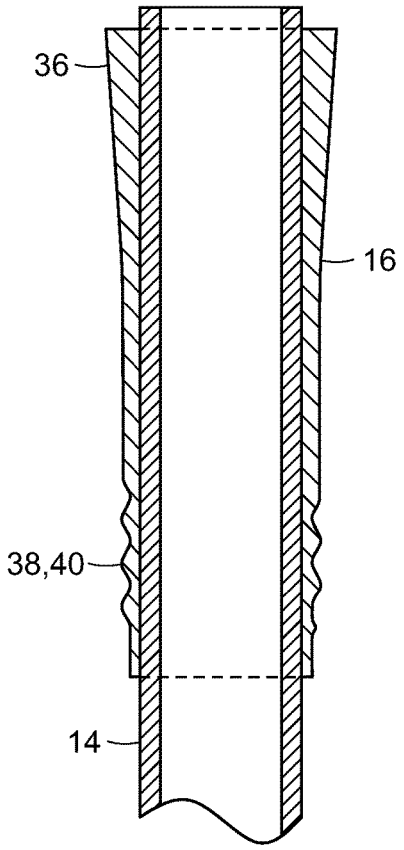
FIG. 11 is a cross-sectional view of FIG. 10.
Figure 12:
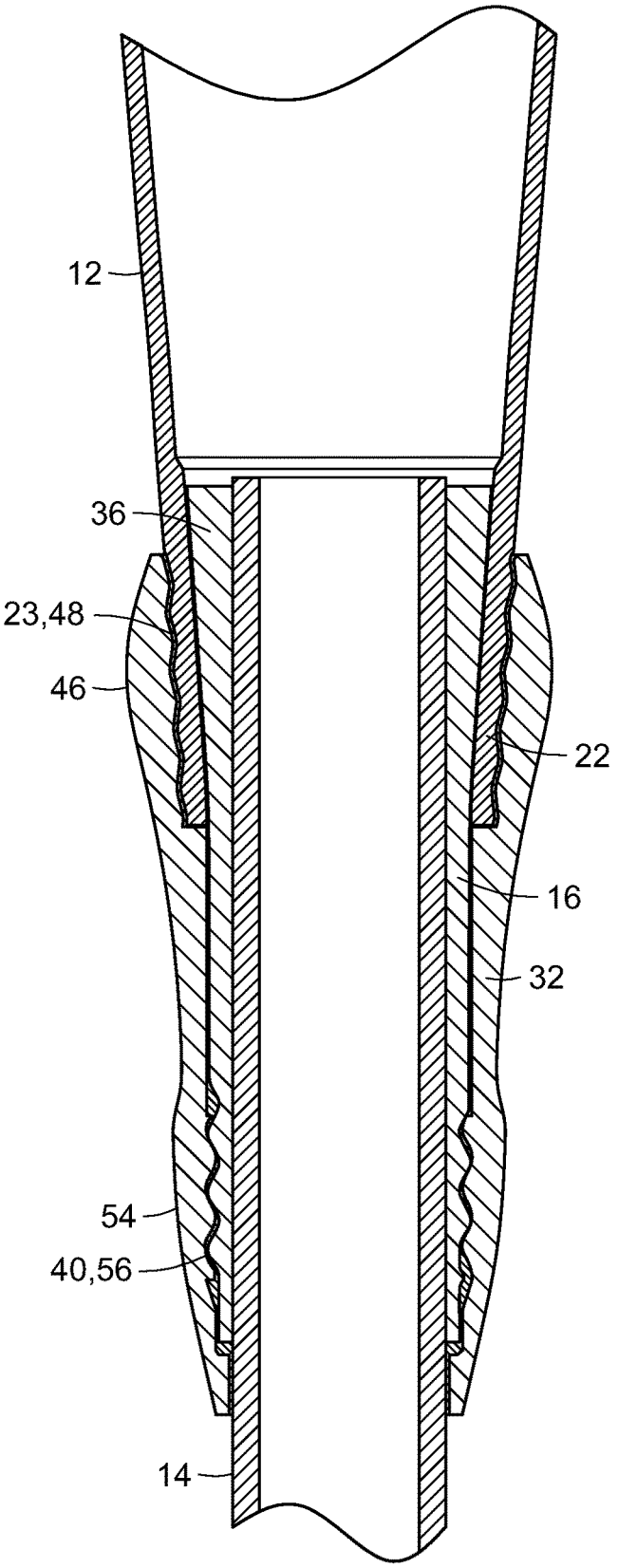
FIG. 12 is a cross-sectional view of a bat embodying the present invention, illustrating incorporation of the vibration absorber of FIG. 10.
Figure 13:
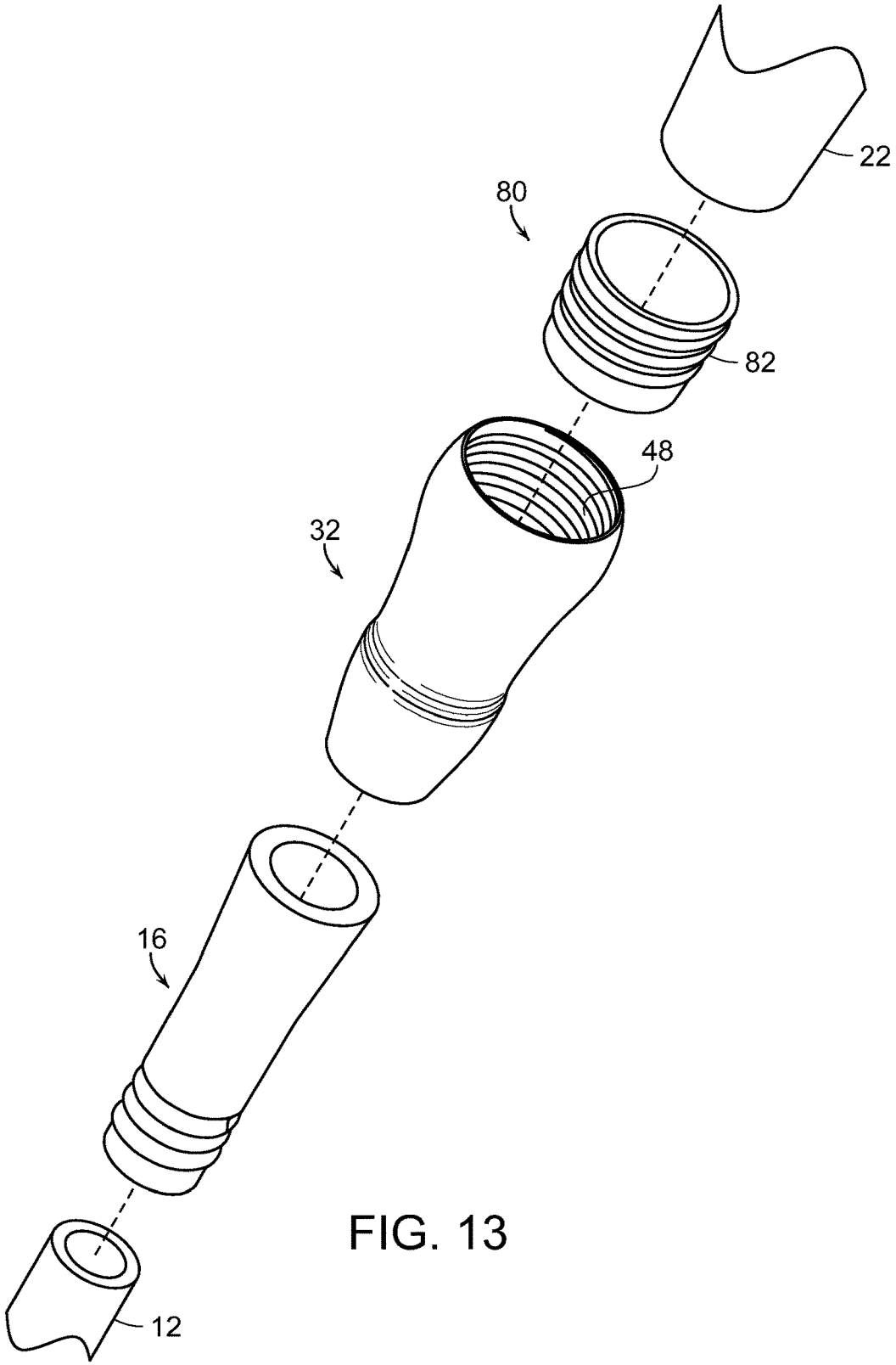
FIG. 13 is a partially fragmented and exploded perspective view of components of a bat embodying the present invention incorporating a vibration dampening sleeve.
Figure 14:
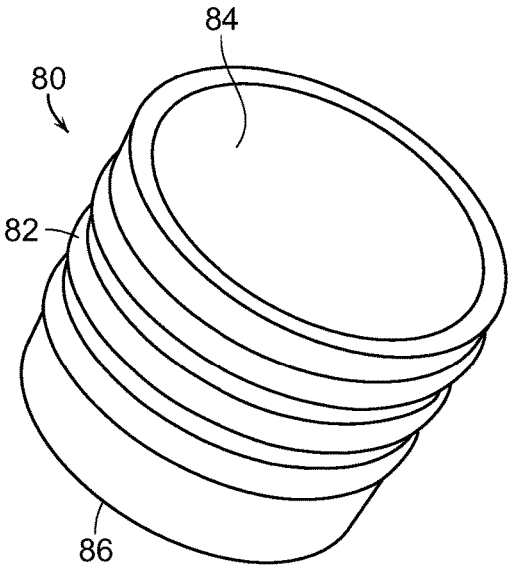
FIG. 14 is a perspective view of a vibration dampening sleeve embodying the present invention.
Figure 15:
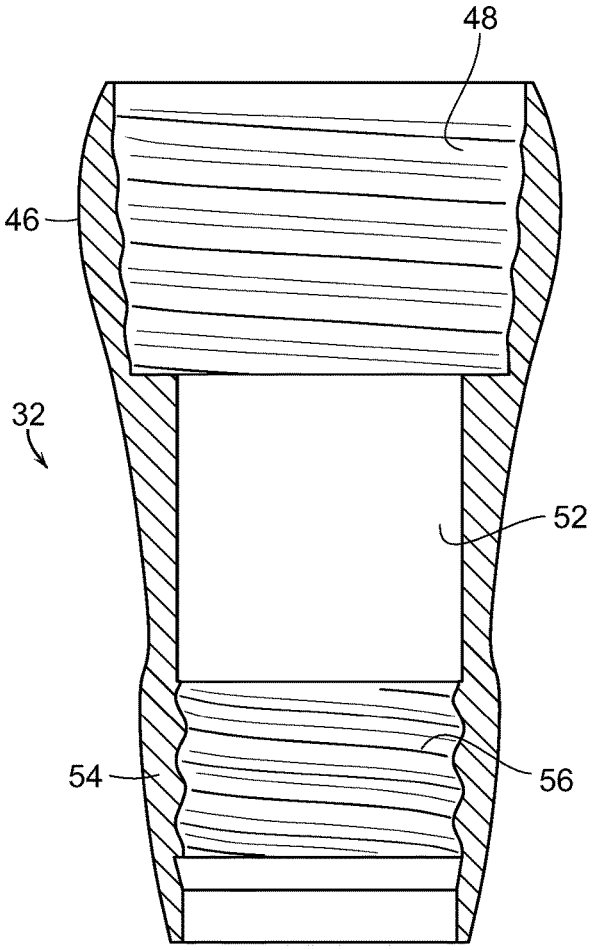
FIG. 15 is a cross-sectional view of an outer locking sleeve used in connection with the vibration dampening sleeve of FIG. 14.

With reference now to FIGS. 10-12, the vibration absorber 16 may be molded without any projections or depressions on the first section 36 thereof. Instead, the first section 36 of the vibration absorber 16 may be generally smooth and tapered, so as to substantially mate with the inner smooth tapered surface of the proximal end 22 of the barrel 12. In this manner, there is a full contact of surfaces between the outer surface of the first section 36 of the vibration absorber 16 and the inner surface of the proximal end 22 of the barrel 12, as illustrated in FIG. 12. Attachment of the outer locking sleeve 32 to the second section 38 of the vibration absorber 16 as well as the proximal end 22 of the barrel increasingly pulls the handle 14 downwardly and into the proximal end 22 of the barrel 12 and also brings the barrel 12 and handle 14 toward one another and forms a tight connection therebetween.

Figure 16:
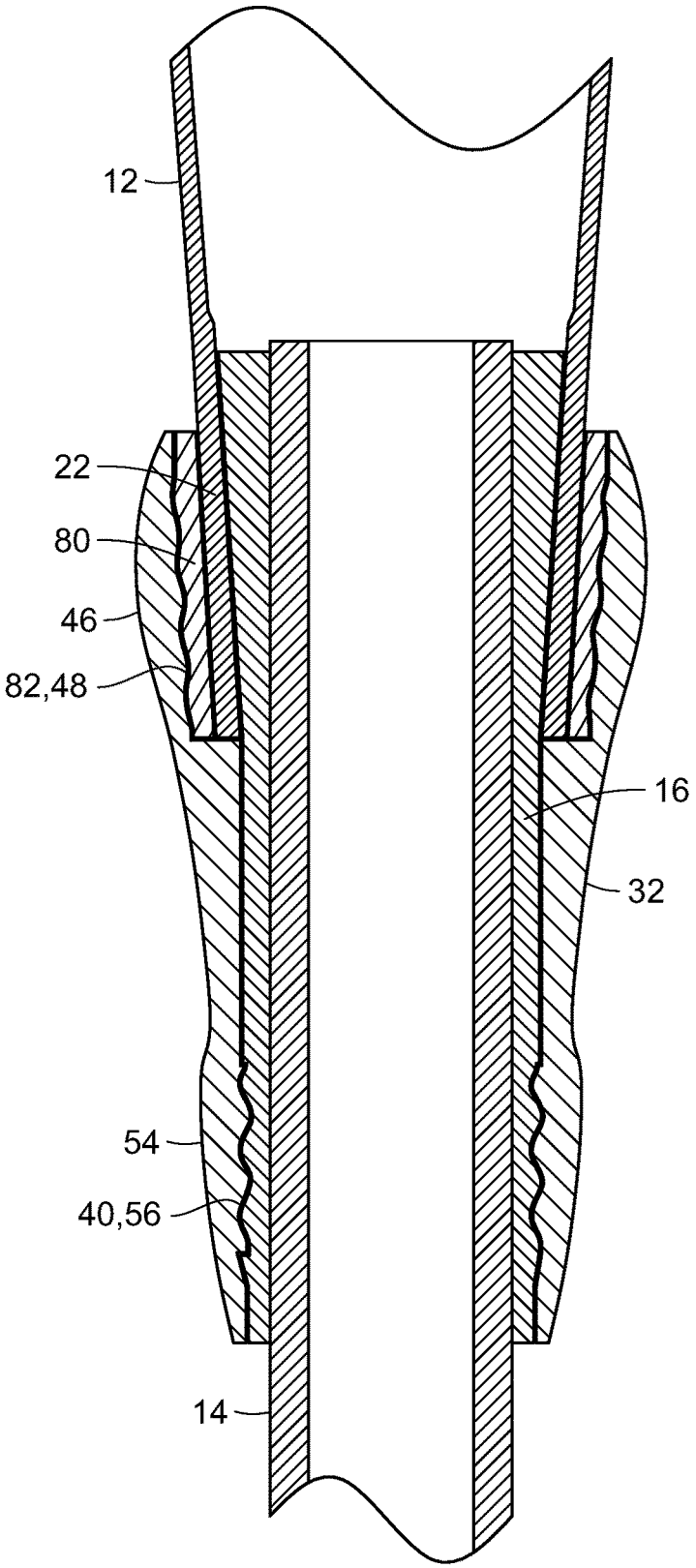
FIG. 16 is a cross-sectional view of a portion of a bat embodying the present invention and incorporating the vibration dampening sleeve and outer locking sleeve of FIGS. 14 and 15.

With reference now to FIGS. 13-16, a vibration dampening sleeve 80 may be incorporated into the present invention and disposed between an outer surface of the proximal end 22 of the barrel 12 and an inner surface of the first portion 46 of the outer locking sleeve 32. This is illustrated in FIG. 16. Incorporation of the vibration dampening sleeve 80, which is comprised of a vibration dampening material such as an elastomeric material or the like, provides a double vibration dampening arrangement around the proximal end 22 of the barrel 12, in that the proximal end 22 of the barrel 12 is sandwiched between the vibration dampener 16 and the vibration dampening sleeve 80. This provides additional vibration dampening characteristics, including dampening vibrations on the outer surface of the barrel 12.

In the embodiment illustrated in FIGS. 13-16, the inner surface of the first portion 46 of the outer locking sleeve 32 is configured so as to extend over the vibration dampening sleeve 80. In a particularly preferred embodiment, as illustrated, the outer surface of the vibration dampening sleeve includes projections and depressions, such as in the form of threads 82, which are engaged by internal threads 48 of the outer locking sleeve 32.

The vibration dampening sleeve 80 is generally cylindrical in configuration and hollow with apertures 84 and 86 so that the vibration dampening sleeve 80 may be disposed over the proximal end 22 of the barrel 12. The inner surface of the vibration dampening sleeve 80 is in contact with the outer surface of the proximal end 22 of the barrel 12. Typically, these surfaces will substantially mate and conform with one another. For example, the inner surface of the vibration dampening sleeve 80 may be generally smooth and tapered, or it may have internal threads which engage with the external threads 23 of the proximal end 22 of the barrel 12.

With reference to FIG. 16, once the handle 12 has been inserted through the barrel 12 until the vibration absorber 16 is lodged within the proximal end 22 of the barrel, and the vibration dampening sleeve 80 is disposed over the outer surface of the proximal end 22 of the barrel 12, the outer locking sleeve 32 is slid over the handle 12 until it comes into contact with the vibration dampening sleeve 80, at which point it is rotated, causing the threads 48 of the upper portion 46 of the outer locking sleeve 32 to be increasingly threadedly engaged with the external threads 82 of the vibration dampening sleeve while the internal threads 56 of the lower portion 54 of the outer locking sleeve 32 are engaged with the outer threads 40 of the second section of the vibration absorber 16. The outer locking sleeve 32 is rotated until a full connection is made between these components, which essentially locks the barrel 12 to the handle 14 and sandwiches the proximal end 22 of the barrel 12 between the vibration absorber 16 and the vibration dampening sleeve 80, and creates a rigid sleeve and connection over the joint between the barrel 12 and handle 14.

The joinder of the components mentioned above enables the barrel 12 to be connected to the handle 14 and provide shock absorbing characteristics, so as to prevent or reduce shockwaves and vibrations from travelling from the barrel 12 to the grip portion of the handle 14 and thus the hands of the user. These connections are sufficiently secure so as not to require adhesive. However, a polymeric gel or silicone-rubber lubricant or elastomeric adhesive or other flexible adhesive which does not harden, shown by the darker black line in FIGS. 9, 12 and 16, may be disposed between the engaged surfaces of the vibration absorber 16 and barrel 12 and outer locking sleeve 32, and the engaging surfaces of the vibration dampening sleeve 80 and the barrel 12 and outer locking sleeve 32, and particularly the threaded connections of the outer locking sleeve 32, to further fix these components in place and prevent disassembly. Use of flexible or non-hardening gels or adhesives overcomes the drawback of the prior art where hardening adhesives will crack and break over time as the bat is used in hitting objects. Coating the contacting surfaces of the invention with the gel or rubber forms of silicone avoids gaps and provides a tighter fitting between these components.

Although several embodiments have been described in detail for purposes of illustration, various modifications may be made without departing from the scope and spirit of the invention. Accordingly, the invention is not to be limited, except as by the appended claims.

What is claimed is:

1. A baseball or softball bat, comprising:

a barrel having a distal end and a proximal end;

a handle comprising a first end segment defining a grip and a second end segment at least partially disposed within the proximal end of the barrel;

a vibration absorber affixed to the second end segment of the handle and comprised of a shock absorbing material, the vibration absorber having a first section disposed within the proximal end of the barrel so as to contact an inner surface thereof, and a second section disposed outside of the barrel and having projections or depressions on an external surface thereof; and an outer locking sleeve having a first portion disposed over the proximal end of the barrel and a second portion disposed over the second section of the vibration absorber, the second portion of the outer locking sleeve having projections or depressions formed on an inner surface thereof that engage the corresponding projections or depressions of the vibration absorber so as to securely lock the barrel to the handle.

2. The bat of claim 1, wherein the outer locking sleeve comprises a rigid material.

3. The bat of claim 1, wherein the vibration absorber comprises an elastomeric material.

4. The bat of claim 1, wherein the vibration absorber is molded onto the second end segment of the handle.

5. The bat of claim 1, wherein the second portion of the locking sleeve and the second section of the vibration absorber are threadedly connected to one another.

6. The bat of claim 1, wherein an outer surface of the first section of the vibration absorber is configured so as to mate with an inner surface of the proximal end of the barrel.

7. The bat of claim 6, wherein an inner surface of the proximal end of the barrel is frustoconical and the outer surface of the first section of the vibration absorber is frustoconical so as to contact the inner surface of the proximal end of the barrel.

8. The bat of claim 1, wherein the inner surface of the proximal end of the barrel and the first section of the vibration absorber include a corresponding projection and depression so as to lockingly engage one another.

9. The bat of claim 8, wherein the projection and depression are annular.

10. The bat of claim 1, wherein the outer locking sleeve includes a plurality of slots formed therethrough between first and second ends of the outer locking sleeve.

11. The bat of claim 10, including a sensor disposed within a slot of the outer locking sleeve.

12. The bat of claim 1, including a vibration dampening sleeve disposed between an outer surface of the proximal end of the barrel and an inner surface of the first portion of the outer locking sleeve.

13. The bat of claim 12, wherein the vibration dampening sleeve has external threads that engage internal threads of the first portion of the locking sleeve.

14. The bat of claim 1, including a flexible adhesive disposed between inner surfaces of the outer locking sleeve and outer surfaces of the vibration absorber and proximal end of the barrel.

15. The bat of claim 1, wherein an inner surface of the first portion of the outer locking sleeve has projections or depressions formed therein which engage corresponding projections or depressions on an outer surface of the proximal end of the barrel.

16. A baseball or softball bat, comprising: a barrel having a distal end and a proximal end; a handle comprising a first end segment defining a grip and a second end segment at least partially disposed within the proximal end of the barrel; a vibration absorber affixed to the second end segment of the handle and comprised of a shock elastomeric absorbing material, the vibration absorber having a first section disposed within the proximal end of the barrel so as to mate with an inner surface of the proximal end of the barrel, and a second section disposed outside of the barrel and having threads on an external surface thereof; an outer locking sleeve comprised of a rigid material having a first portion disposed over the proximal end of the barrel and a second portion disposed over the second section of the vibration absorber, the first portion of the outer locking sleeve having threads formed on an inner surface thereof that threadedly engage corresponding threads on an exterior surface of the proximal end of the barrel, and the second portion of the outer locking sleeve having threads formed on an inner surface thereof that threadedly engage the corresponding threads of the vibration absorber so as to securely lock the barrel to the handle; and a vibration dampening sleeve disposed between an outer surface of the proximal end of the barrel and an inner surface of the first portion of the locking sleeve.

17. The bat of claim 16, wherein the vibration absorber is molded onto the second end segment of the handle.

18. The bat of claim 16, wherein an inner surface of the proximal end of the barrel is frustoconical and the outer surface of the first section of the vibration absorber is frustoconical so as to contact the inner surface of the proximal end of the barrel.

19. The bat of claim 16, wherein the inner surface of the proximal end of the barrel and the first section of the vibration absorber include a corresponding projection and depression so as to lockingly engage one another.

20. The bat of claim 19, wherein the projection and depression are annular.

21. The bat of claim 16, wherein the outer locking sleeve includes a plurality of slots formed therethrough between first and second ends of the outer locking sleeve.

22. The bat of claim 21, including a sensor disposed within a slot of the outer locking sleeve.

23. The bat of claim 16, wherein the vibration dampening sleeve has external threads that engage internal threads of the first portion of the locking sleeve.

24. The bat of claim 16, including a flexible adhesive disposed between inner surfaces of the outer locking sleeve and outer surfaces of the vibration absorber and proximal end of the barrel.

* * * * *